US006923520B2

(12) United States Patent
Oikawa et al.

(10) Patent No.: US 6,923,520 B2
(45) Date of Patent: Aug. 2, 2005

(54) HEAD DRIVING UNIT AND AN IMAGE FORMING APPARATUS USING THE SAME

(75) Inventors: Tatsuhiko Oikawa, Kanagawa (JP); Toshihito Kamei, Tokyo (JP); Takashi Kimura, Kanagawa (JP); Sumiaki Aoki, Kanagawa (JP); Mikio Ohashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/172,592

(22) Filed: Jun. 14, 2002

(65) Prior Publication Data

US 2003/0011653 A1 Jan. 16, 2003

(30) Foreign Application Priority Data

Jun. 20, 2001 (JP) ..... 2001-185732

(51) Int. Cl.[7] ..... B41J 29/38

(52) U.S. Cl. ..... 347/11; 347/10; 347/12; 347/15

(58) Field of Search ..... 347/10, 11, 68, 347/12, 41, 15; 400/124.01

(56) References Cited

U.S. PATENT DOCUMENTS 6,022,092 A * 2/2000 Misumi ..... 347/10
6,283,568 B1 * 9/2001 Horri et al. ..... 347/10
6,517,267 B1 * 2/2003 Otsuki ..... 400/124.01

FOREIGN PATENT DOCUMENTS

EP 0827838 A2 * 3/1998
JP 671882 3/1994

* cited by examiner

*Primary Examiner*—Hai Pham
*Assistant Examiner*—Lam Nguyen
(74) *Attorney, Agent, or Firm*—Cooper & Dunham LLP

(57) ABSTRACT

A head driving unit the generates a driving waveform, each driving waveform including a plurality of driving pulses, and selects one or more driving pulses to be applied to a liquid drop discharging head in response to data corresponding to an image. By selecting a plurality of selection signals that defines the driving pulses to be applied to the liquid discharging head, the head driving unit can change a recording density or record multiple value images.

5 Claims, 14 Drawing Sheets

FIG.14

| NO. | A DATA | B DATA | SELECTION M SIGNAL | NUMBER OF DOTS | RECORDING DENSITY | MULTIPLE VALUE CONTROL (4 VALUES) |
|---|---|---|---|---|---|---|
| 1 | 0 | 0 | NONE | NO PRINTING | NO PRINTING | NO PRINTING |
| 2 | 1 | 0 | M1 | (1 DROP) | 1200dpi | SMALL DROP |
| 3 | 0 | 1 | M2 | (2 DROPS) | 600dpi | MEDIUM DROP |
| 4 | 1 | 1 | M3 | (3 DROPS) | 300dpi | LARGE DROP |

FIG.17

| NO. | A DATA | B DATA | SELECTION M SIGNAL | NUMBER OF DOTS | RECORDING DENSITY | MULTIPLE VALUE CONTROL (3 VALUES) |
|---|---|---|---|---|---|---|
| 1 | 0 | 0 | NONE | NO PRINTING | NO PRINTING | NO PRINTING |
| 2 | 1 | 0 | M1 | NO DISCHARGING | NO PRINTING | NO PRINTING |
| 3 | 0 | 1 | M2 | (1 DROP) | 1200dpi | SMALL DROP |
| 4 | 1 | 1 | M3 | (2 DROPS) | 600dpi | MEDIUM DROP |

HEAD DRIVING UNIT AND AN IMAGE FORMING APPARATUS USING THE SAME

BACKGROUND OF THE INVENTION

1. Field of the Invention

The present invention generally relates to a head driving unit and an image forming apparatus, and more particularly, to an image forming apparatus having a liquid drop discharging head and a head driving unit for driving the liquid drop discharging head.

2. Description of the Related Art

An ink jet recording apparatus to be used as image forming apparatuses such as a printer, a facsimile, a photocopier, a plotter (an imaging apparatus) is provided with an ink jet head for discharging liquid drops consisting of a nozzle that discharges ink drops, an ink flow path (referred to as a discharging room, a pressure force room, a pressure liquid room, or a liquid room) that is connected to the nozzle, a driving unit that pressurizes the ink in this ink flow path.

Liquid drop discharging heads such as a liquid drop discharging head for discharging a liquid resist and for discharging a sample of DNA as liquid drops are known, but we focus on ink jet heads in the following description.

At least three types of ink jet heads are known in the art.

The so-called piezoelectric type uses a piezoelectric element as a driving unit to pressurize ink in the ink flow path. The piezoelectric element moves a diaphragm forming a wall surface of the ink flow path and changes the volume of the ink flow path to discharge ink drops.

The so-called bubble type uses a heat generating resistor. The heat generating resistor heats the ink in the ink flow path and generates bubbles to pressurize the ink.

On the other hand, an electrostatic type (cf. Japanese Patent Laid-Open Application No. 6-71882) uses a diaphragm and an electrode facing each other forming a wall surface of an ink flow path. The diaphragm is moved by the electrostatic force generated between the diaphragm and the electrode and changes the volume of the ink flow path to discharge ink drops.

A driving unit of an ink jet head generates a common driving waveform to be applied to a driver corresponding to each nozzle and controls a switch corresponding to each driver depending on a recording image.

The driving unit drives the head by switching on and off the common driving waveform applied to each driver in response to a signal indicating the recording image.

By the way, in order to obtain a suitable driving waveform to be applied to each driver element of an ink jet head, driving parameters such as driving voltage, pulse width, rise time and fall time of a pulse must be set at an optimum condition depending on the ink jet head.

Therefore, in the case of a conventional head driving unit using a common driving waveform, whenever the recording density is changed, for example, the common driving waveform, that is, the driving parameters defining the common driving waveform, must be changed as well in order to obtain the optimum dot diameter most suitable for the recording density.

When multiple value recording is required, the quantity of ink in an ink drop discharged must be changed, nozzle by nozzle, to change dot diameters. Different driving waveforms must be applied to each nozzle. The more head nozzles required, the more driving waveform generators are required to generate common driving waveforms. The cost increase is not negligible.

SUMMARY OF THE INVENTION

Accordingly, it is a general object of the present invention to provide a novel and useful head driving unit and image forming apparatus. Another and more specific object of the present invention is to provide a simply structured head driving unit that can comply with a recording density change and multiple level recording, and a low cost image forming apparatus using the same.

To achieve one of the above objects, a head driving unit that drives a liquid drop discharging head having a nozzle to discharge liquid drops, a liquid room connected to said nozzle, and a pressurizing unit to pressurize liquid in said liquid room, according to the present invention, includes a waveform generation unit that generates a driving waveform, each driving waveform including a plurality of driving pulses, a data latch unit that latches data corresponding to an image, a signal selection unit that selects one or more driving pulses to be applied to said pressurizing unit of said liquid drop discharging head in response to said data latched by said data latch unit, the driving pulses being included in said driving waveform. The signal selection unit selects a plurality of selection signals that defines the driving pulses to be applied to said pressurizing unit. Accordingly, the head driving unit, even having a simple structure, can comply with a recording density change and provide multiple value recording.

If applicable, it is desired that the plurality of selection signals determines the number of driving pulses in said driving waveform, so that the structure of the head driving unit becomes even simpler.

If applicable, it is desired that one of the plurality of driving pulses included in said driving waveform is a driving pulse that does not cause said pressurizing unit to discharge a liquid drop so that the head driving unit can prevent the clogging of nozzles and ensure stable discharging of liquid drops.

The image forming apparatus according to the present invention includes the head driving unit according to the present invention so that the image forming apparatus can change the recording density and/or record multiple valued images with a simple and lo cost structure.

Other objects, features, and advantages of the present invention will become more apparent from the following detailed description when read in conjunction with the accompanying drawings.

BRIEF DESCRIPTION OF DRAWINGS

FIG. 14 is a table showing the relationship between a selection signal and selected driving pulses of the common driving waveform according to the first embodiment of the present invention;

FIG. 17 is a table showing the relationship between a selection signal and selected driving pulses of the common driving waveform according to the second embodiment of the present invention.

DETAILED DESCRIPTION OF THE PREFERRED EMBODIMENTS

A detailed description of the preferred embodiments will be given below by reference to the attached drawings.

Figure 1:
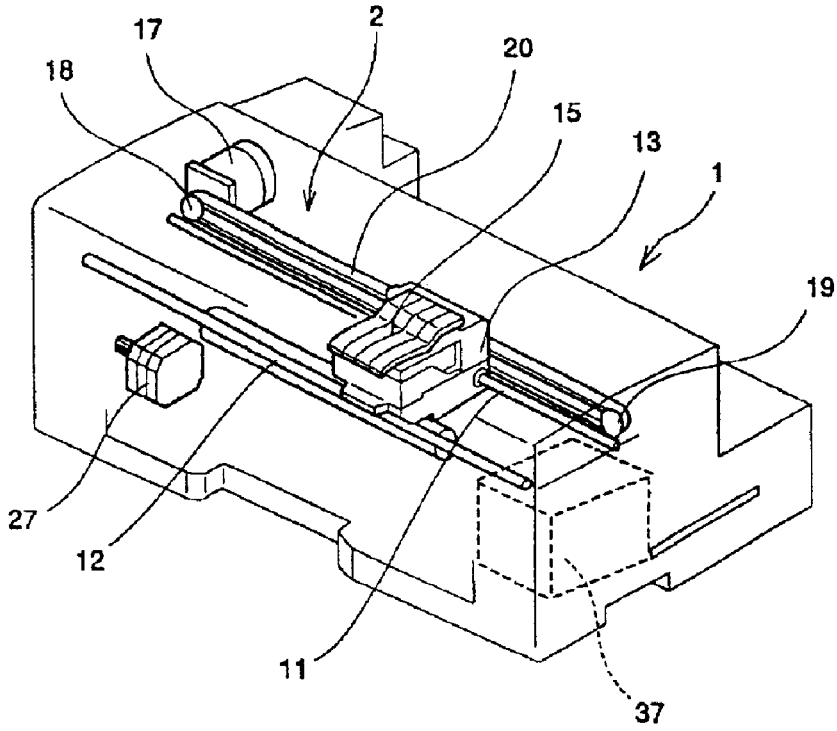
FIG. 1 is an isometric drawing showing an ink jet recording apparatus according to an embodiment of the present invention.
Figure 2:
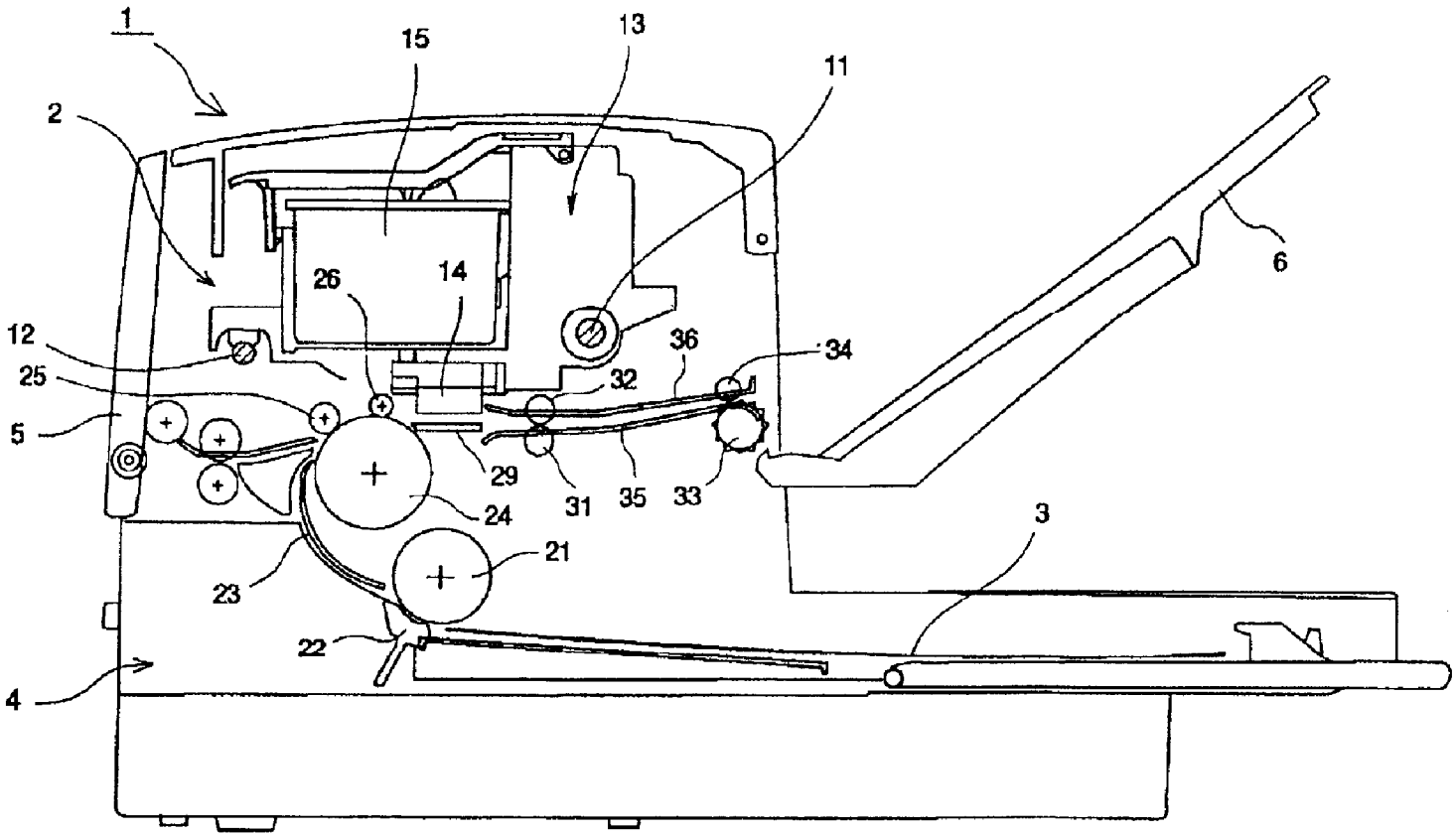
FIG. 2 is a cross-sectional view of the ink jet recording apparatus showed in FIG. 1.

FIG. 1 is an isometric illustration of a mechanism of an ink jet recording apparatus according to an embodiment of the present invention, FIG. 2 is a cross sectional side view of the mechanism of FIG. 1.

This ink jet recording apparatus according to an embodiment includes a carriage 13 that can move in a main scanning direction in the main body 1 of the recording apparatus, a recording head 14 consisting of ink jet heads mounted on the carriage 13, and a printing mechanism 2 comprising ink cartridges 15 that supply ink to the recording head.

The ink jet recording apparatus takes in paper 3 fed by a paper feeding cassette 4 or hand feeding tray 5, records a certain image on the paper 3 using the printing mechanism 2, and ejects the paper 3 to an eject tray 6 mounted on the backside.

The printing mechanism 2 holds the carriage 13 in a manner in which the carriage 13 can slide freely in the main scanning direction (in the direction perpendicular to the sheet of FIG. 2) with a main guiding rod 11 and sub guiding rod 12 that are guiding members stretching between the right and left side plates (not shown).

On this carriage 13, a head 14 consisting of ink jet heads for discharging ink drops of respective colors, yellow (Y), cyan (C), magenta (M), and black (Bk), is attached in a manner in which the ink drops are discharged downward.

Ink tanks (ink cartridges) 15 that supply ink of respective colors to the heads 14 are provided above the carriage 13 in a detachable manner.

The ink cartridge 15 has an air port connected to the atmosphere in the upper portion and an ink port through which ink is supplied to the ink jet head 14 in the bottom portion.

The ink cartridge 15 also has porous material inside filled with ink, and the ink to be supplied to the ink jet head 14 is maintained at a slightly negative pressure by the capillary tube effect of the porous material. This ink cartridge 15 supplies ink to the head 14.

The carriage 13 is tightly fitted to the main guiding rod 11 in the backward side (paper transportation downstream direction) in a manner in which the carriage 13 can slide freely, and is put on the sub guiding rod 12 in the forward side (paper transportation upstream direction) in a manner in which the carriage 13 can slide freely.

This carriage 13 is activated to scan the paper in the main scanning direction by a timing belt 20 that is fixed to the carriage 13.

The timing belt 20 is tensioned between a driving pulley 18 and a driven pulley 19 rotationally driven by a main scanning motor 17.

By rotating the main scanning motor 17 forward and backward, the carriage 13 is moved back and forth.

It is assumed in this description that the recording head 14 consists of a plurality of heads, each discharging ink drops of a color, but one can use a single head that can discharge ink drops of all colors through a nozzle.

Furthermore, it is assumed in this description that a piezoelectric type ink jet head is used as head 14, but those skilled in the art should understand that other types of ink jet heads may be used instead.

The so-called piezoelectric type is an ink jet head that discharges ink drops by changing the volume in the ink flow path caused by the movement of the diaphragm forming a wall surface of the ink flow path with a piezoelectric element.

One may use a so-called bubble type that uses a heat resistor to heat ink in the ink flow path and discharges ink drops in response to the pressure force caused by the generation of bubbles in the ink flow path.

The electrostatic type that consists of a diaphragm and an electrode facing each other and forming at least a portion of the wall surface of the ink flow path discharges ink drops by pressurizing ink by the movement of the diaphragm caused by electrostatic force is also usable.

On the other hand, the following units are provided to transport paper 3 from the paper feed cassette 4 downward under the head 14: a paper feed roller 21 to separate one from a plurality of sheets of paper 3 stored in the paper feed cassette 4; a friction pad 22; a guiding member 23 to guide the sheet of paper 3; a transportation roller 24 to turn over the sheet of paper 3 for further transportation; a transportation roller 25 that is pushed to a surface of the transportation roller 24; and a tip roller 26 that adjusts the angle at which the sheet, of paper 3 is sent out from the transportation roller 24.

The transportation roller 24 is rotationally driven by the sub scanning motor 27 through a series of gears.

A paper guide member 29 having a width corresponding to the movable range of the carriage 13 is further provided to guide the sheet of paper 3 transported by the transportation roller 24 under the recording head 14.

In the downstream direction of this paper guide member 29, the following units are further provided: a transportation roller 31 that is rotationally driven to send the paper 3 forth to an ejecting direction; a spur 32; an eject roller 33 to send paper 3 forth in eject tray 6; a spur 34; and guiding members 35 and 36 that form an eject path.

In a recording operation, while the carriage 13 is moving, the recording head 14 is activated in response to an image signal to record a line of the image by discharging ink drops to the paper 3 staying still.

Before recording the next line, the paper 3 is transported by a predetermined distance. When a record end signal or a signal indicating that the rear end of the paper 3 has arrived at the recording region, the recording operation is completed and the paper 3 is ejected.

A recovery apparatus 37 to enable the head 14 to recover from discharging difficulty is provided at a position in the right movable direction of the carriage 13 out of the recording region.

The recovery apparatus 37 has a capping unit, an absorption unit, and a cleaning unit. The carriage 13, while standing by for printing, moves to this recovery apparatus 37 so that the head 14 is capped with the capping unit.

The discharging difficulty is prevented by keeping a discharging port (a nozzle opening) wet, not allowing the ink to dry. Additionally, in the middle of recording, the head 14 discharges ink drops that are irrelevant to the recording (purging) to maintain the viscosity of ink to be discharged uniform. Accordingly the discharging performance of the head 14 remains stable.

In the case that discharging difficulties occur, a capping unit seals up the discharging opening of the head 14 (nozzle), an absorption unit evacuates ink and bubbles from the discharging opening through a tube, and a cleaning unit removes ink and contamination sticking to the discharging opening surface.

Accordingly, the head 14 recovers from the discharging difficulties. The evacuated ink is exhausted to an ink storage (not shown) installed in the lower portion of the main body and absorbed by an ink absorber of the ink storage.

Next, an example of an ink jet head constituting the head 14 is described by reference to FIGS. 3–6.

Figure 3:
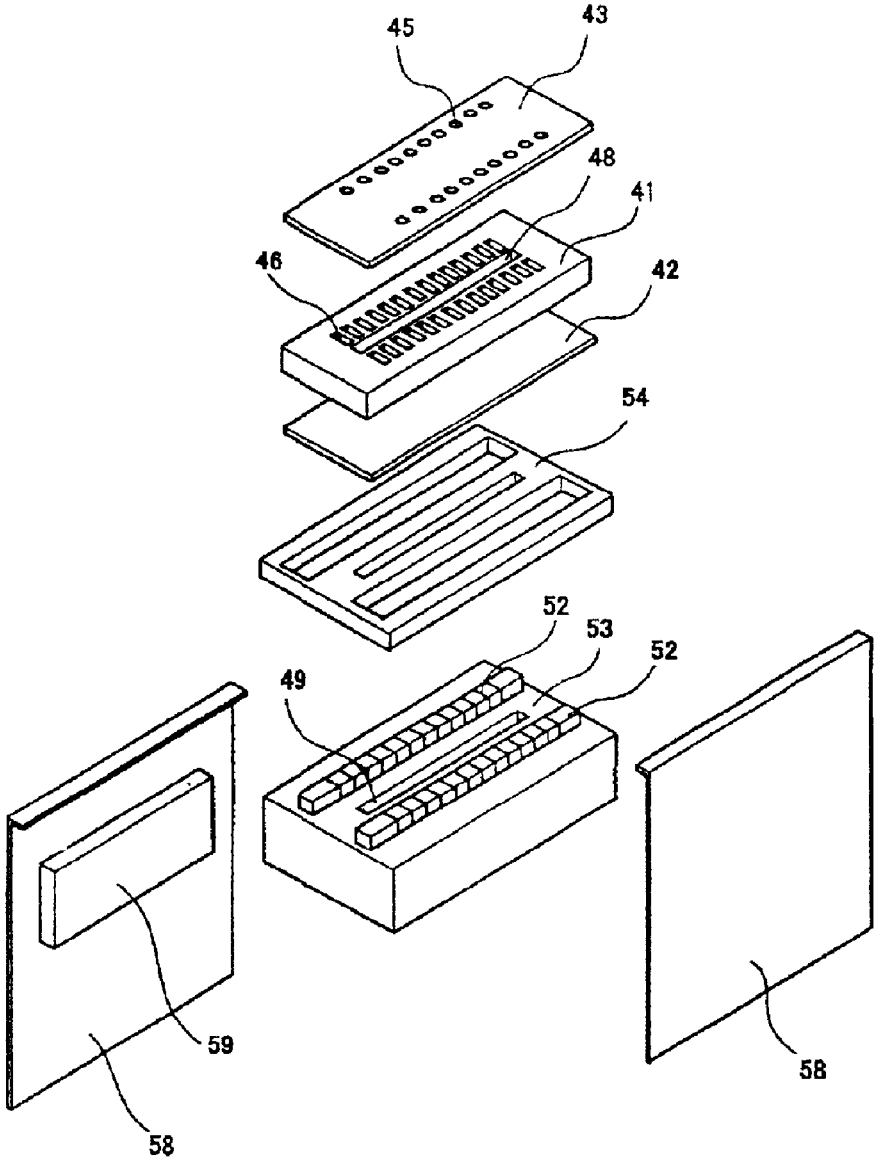
FIG. 3 is an exploded view of an ink jet head according to an embodiment of the present invention.
Figure 4:
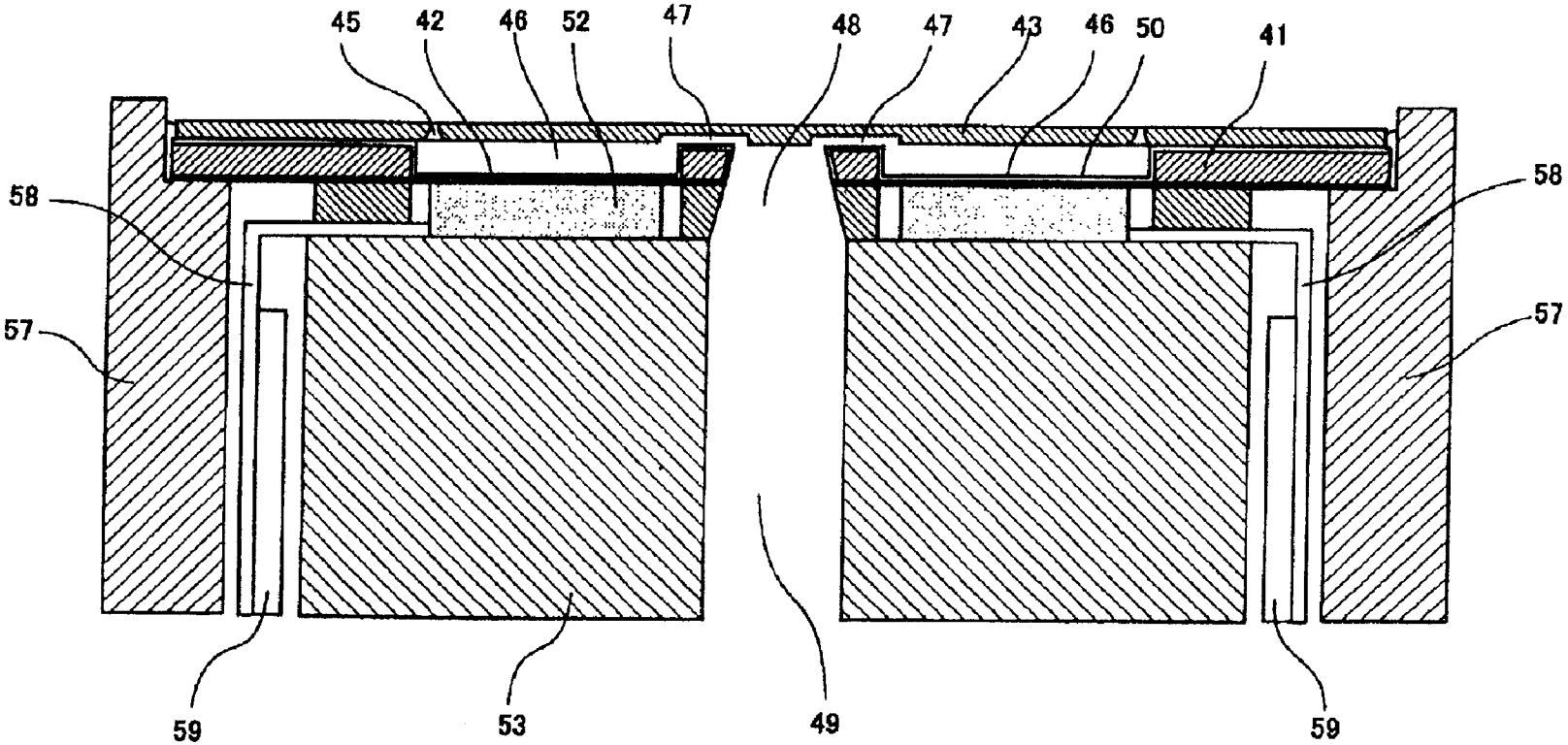
FIG. 4 is a cross-sectional view of the ink jet head showed in FIG. 3, in the direction of the longer side of the liquid room.
Figure 5:
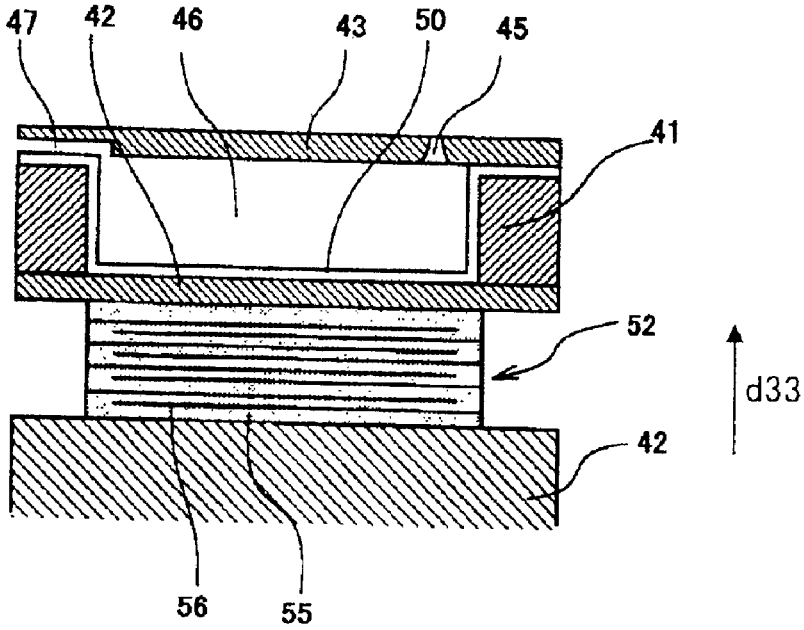
FIG. 5 is an expanded view of a portion showed in FIG. 4.
Figure 6:
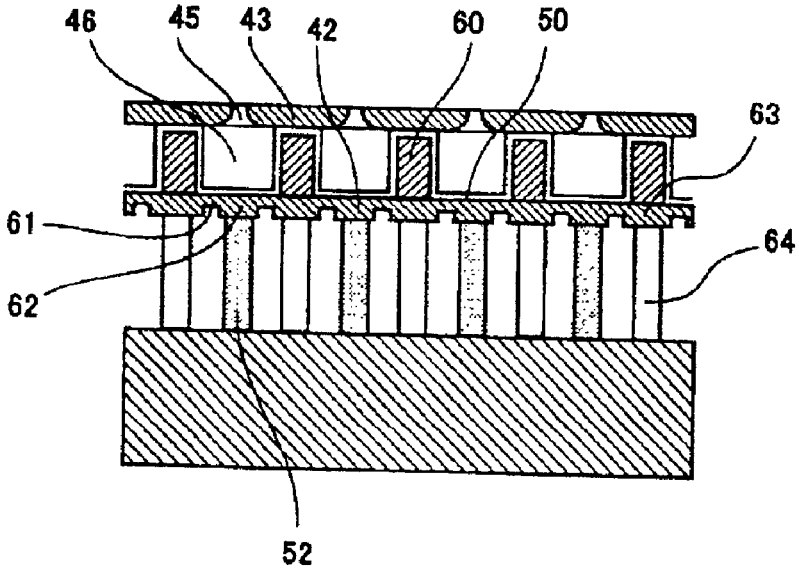
FIG. 6 is a cross-sectional view of the ink jet head showed in FIG. 3, in the direction of the shorter side of the liquid room.

FIG. 3 is an exploded view illustration of the head; FIG. 4 is a section illustration along a long edge of the liquid room 46 of the head; FIG. 5 is a magnified illustration of FIG. 4; and FIG. 6 is a section illustration along a liquid room 46 short edge direction of the head.

This ink jet head is structured by the following units: a flow path formation substrate (a flow path formation member) 41 formed by a single crystal silicon substrate; a diaphragm 42 joined with the bottom face of this flow path formation substrate 41; and a nozzle plate 43 joined with the top face of flow path formation substrate 41.

These units form a pressurized liquid room 46, an ink supply path 47, and a common liquid room 48. The pressurized liquid room 46 is a liquid flow path (ink liquid room) to which a nozzle 45 is connected.

The ink supply path 47 becomes a fluid resistance unit. The common liquid room 48 supplies ink through the ink supply path 47 to the pressurized liquid room 46.

The surface of the flow path forming substrate 41, that is, the pressurized liquid room 46, the ink supply path 47, and the common liquid room 48, are covered by a liquid proof layer 50 made of organic resin.

A laminating type piezoelectric element 52 corresponding to each pressurized liquid room 46 is bonded on the diaphragm 42 opposite to the liquid room.

This laminating type piezoelectric element 52 is fixed to the base substrate 53.

A spacer member 54 is bonded to the base substrate 53 in circumference of a series of the piezoelectric elements 52.

As showed in FIG. 5, this piezoelectric element 52 is formed by laminating piezoelectric material 55 and internal electrodes 56 alternately.

In this embodiment, as shown in FIG. 5, the piezoelectric element 52 moves in the d33 direction (displacement in the direction perpendicular to the laminating direction) and pressurizes ink in pressurized liquid room 46.

Those skilled in the art should understand that they can use the displacement in the d33 direction (displacement in the direction perpendicular to the laminating direction) in order to pressurize ink in the pressurized liquid room 46.

In the base substrate 53 and the spacer member 54, a through hole is formed as an ink supplying port 49 through which ink is supplied to the common liquid room 48 from the outside.

The flow path formation substrate 41 and the diaphragm 42 are adhesively bonded to head frame 57, which is formed by injection molding of epoxy resin or poly-phenylene sulfide, at their outer marginal portion and outer edge of the bottom face, respectively.

These head frame 57 and base substrate 53 are mutually fixed with adhesive material, for example, which is not showed in the drawing.

Furthermore, an FPC cable 58 is connected to the piezoelectric element 52 to provide a driving signal by soldering, ACF (an anisotropy conductive film), or wire bonding.

A driving circuit (driver IC) 59 that applies a driving waveform to each piezoelectric element 52 selectively is attached to this FPC cable 58.

The flow path formation substrate 41 is made of a single crystal silicon substrate having a crystal plane direction (110) by performing anisotropic etching using an alkaline etchant such as water solution of potassium hydroxide (KOH).

A through hole that forms pressurized liquid room 46, a ditch that forms ink supply path 47, and a through hole that forms common liquid room 48 are formed on the flow path formation substrate 41.

In this case, adjacent pressurized liquid rooms 46 are separated by partition units (liquid room dividing walls) 60.

The diaphragm 42 is made of nickel metal plate formed by the electroforming method. This diaphragm 42 has a thin wall portion 61 corresponding to the pressurized liquid room 46, which makes movement of the diaphragm 42 easy, and a thick wall portion 62 to be bonded with the piezoelectric element 52.

The diaphragm 42 has another thick wall portion 63 corresponding to the liquid room dividing wall 60. The thick wall portion 63, of which a flat face is bonded to the flow path formation substrate 41 with adhesive material, is further bonded with the frame 57 with adhesive material.

A fulcrum unit 64 is provided between the thick wall portion 63 and the base substrate 53. This fulcrum unit 64 has the same structure as piezoelectric element 52.

A nozzle plate 43 has nozzles 45 of a diameter of 10–30 $\mu$m, each corresponding to a pressurized liquid room 46, and is bonded to the flow path formation substrate 41 with adhesive material.

To form this nozzle plate 43, one can use various materials. For example, metal such as stainless steel and nickel, a combination of metal and resin such as polyimide resin film, silicon, and combinations of those are usable.

Additionally, a water-repellent film is formed on the nozzle face (discharging face or the face in the discharging direction) by a method known in the art such as plating and water-repellent agent coating to make the face ink-repellent.

The ink jet head structured as described above discharges ink drops in the following manner. A driving pulse of 20–50V is applied to the piezoelectric element 52 selectively. In response to the driving pulse, the piezoelectric element 52 is displaced in the laminating direction (in the case of FIG. 5) and moves the diaphragm 42 in the direction of the nozzle 45.

Since the volume of the pressurization liquid room 46 changes, ink in the pressurization liquid room 46 is pressurized. Accordingly, ink drops are discharged (ejected) through the nozzle 45.

The pressure in the pressurization liquid room 46 decreases in response to the discharge of ink drops, and further decreases up to a slightly negative pressure due to the inertia of the ink flow.

When the voltage application to piezoelectric element 52 is turned off, the pressure in the pressurization liquid room 46 further decreases because the diaphragm 42 returns to its original position and the pressurization liquid room 46 returns to its original shape.

Accordingly, the negative pressure in the pressurization liquid room 46 causes ink to be supplied to the pressurization liquid room 46 through the ink supply port 49, the common liquid room 48, and the ink supply path 47 that is a fluid resistance unit.

After the vibration and an ink meniscus on the side of nozzle 45 is damped and becomes stable, the next pulse voltage is applied to the piezoelectric element 52 to discharge the next ink drop.

Figure 7:
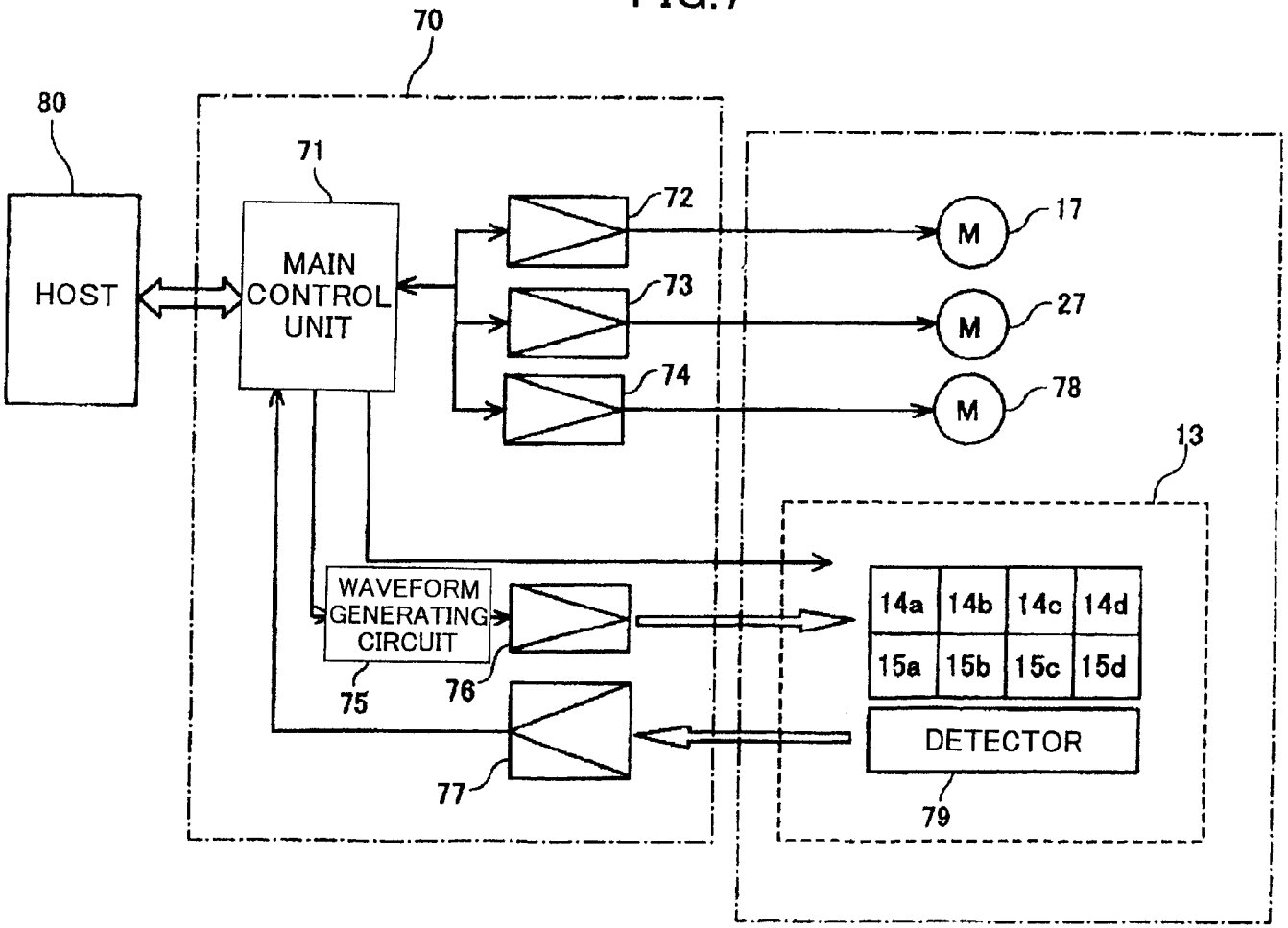
FIG. 7 is a block diagram showing a control unit of the forming apparatus according to the present invention.

Next, a control unit of this ink jet recording apparatus will be described by reference to FIG. 7. This control part 70 is provided with a main control unit 71, motor drivers 72–74, a driving waveform generating circuit 75, a head driver 76, and a detected signal buffer 77.

The main control unit 71 includes a microcomputer that controls the entire forming apparatus, ROM that stores therein fixed information such as driving waveform parameters and a control program, RAM that is used as a working memory, an image memory that stores image data transferred by the host, a parallel I/O (PIO) port, and an input buffer.

The main control unit 71 inputs various data such as image data from host 80, and generates and outputs data to control each unit of the forming apparatus.

The driver 72 activates, in response to driving data from the main control unit 71, a main scanning motor 17 to move the carriage 13 in the main scanning direction. The driver 73 activates, in response to driving data from the main control unit 71, a sub scanning motor 27 to rotate the transportation roller 24. The driver 74 drives a maintenance mechanism motor 78 of the recovery apparatus 37 to absorb ink, for example.

The waveform generating circuit 75 generates a common driving waveform Vcom based on driving waveform data provided from the main control unit 71 and provides the generated common driving waveform Vcom to the head driver 76.

The head driver 76 outputs the common driving waveform Vcom provided from the driving waveform generation circuit 75 to the head drive control circuit corresponding to each head 14*a* through 14*d* to be described later.

A detector buffer 77 inputs detector signals provided by various detectors 79 mounted on the carriage 13, and transfers the detector signals to the main control unit 71.

Figure 8:
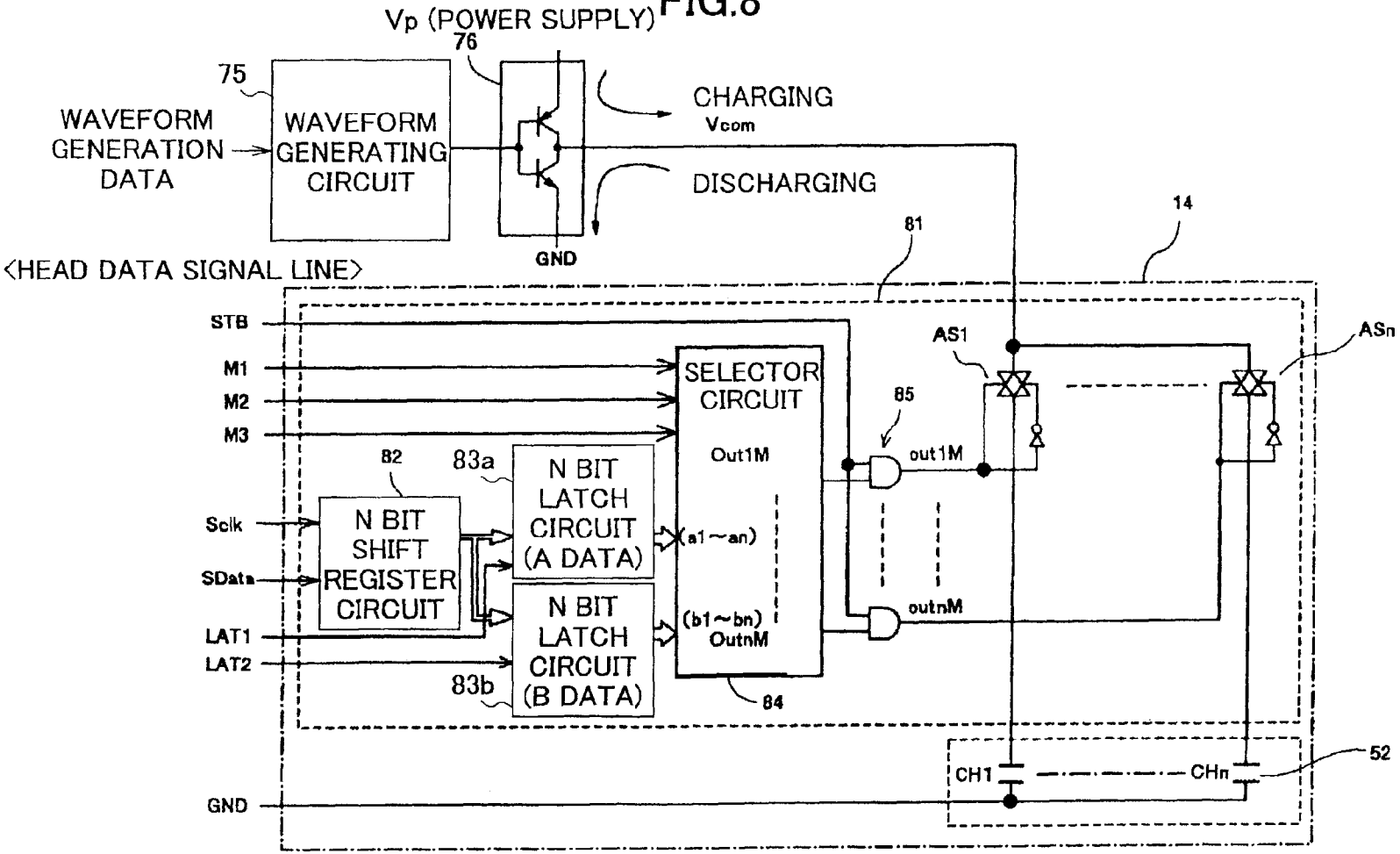
FIG. 8 is a circuit diagram showing a head driving unit of the control unit according to an embodiment of the present invention.

Next, a head driving unit according to an embodiment of the present invention will be explained by reference to FIG. 8. This head driving unit has the waveform generating circuit 75 described above, a head driver 76, and a head driving circuit 81.

The waveform generating circuit 75 generates and outputs a common driving waveform to the piezoelectric element 52 of the head 14 based on the waveform generation data provided from the main control unit 71.

This embodiment employs, as the waveform generating circuit 75, a D/A converter that converts the wave generation data provided from the main control unit 71 into an analog signal.

Those skilled in the art can generate the common driving waveform with a simply structured circuit as described above.

The head driver 76 outputs the common driving waveform Vcom to the head 14 in response to the common driving waveform from the waveform generating circuit 75.

Figure 9:
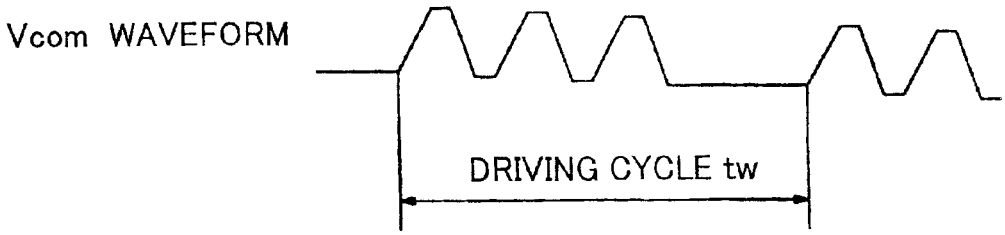
FIG. 9 is a schematic drawing showing a common driving waveform of the head driving unit according to an embodiment of the present invention.

As showed in FIG. 9, the common driving waveform Vcom is a waveform including a plurality of driving pulses P1–P3 (3 pulses in this case) in a driving cycle time tw.

The head driving control circuit 81 inputs, from the main control unit 71, printing signal (serial data) SData, shift clock Sclk, latch signal LAT 1 and 2, selection signal M1, M2, and M3 indicating which driving pulse in the common driving waveform Vcom is to be selected, and strobe signal STB.

This head driving control circuit 81 includes the following units: an n-bit shift register circuit 82 that inputs serial data SData and shift clock Sclk; two n-bit latch circuits 83*a* and 83*b* that hold data provided from the shift register 82, and latch signals LAT1 and LAT2; a selector circuit 84 that selects the selection signals M1–M3 based on the data latched in the latch circuit 83*a* and 83*b* (output a1–an, b1–bn); a group of gate circuits 85 that input the outputs Out1M–OutnM of the selector circuit 84 and turn on and off in response to the strobe signal STB provided from the main control unit 71; analog switches AS1–ASn (assuming n nozzles)that turn on and off in response to the outputs Out1M–OutnM output by the group of gate circuits 85.

These analog switches AS1–ASn input the common driving waveform Vcom provided from the head driver 76. When the common driving waveform Vcom is turned to ON, the selected waveform (pulse) of the common driving waveform Vcom is applied to the piezoelectric element 52 of channels CH1–CHn of the ink jet head.

The operation of the ink jet recording apparatus configured as described above will be described by reference to FIG. 10 and the remaining drawings. The relationship between the common driving waveform Vcom and quantity of ink drop (dot diameter) will be explained first.

Figure 10:
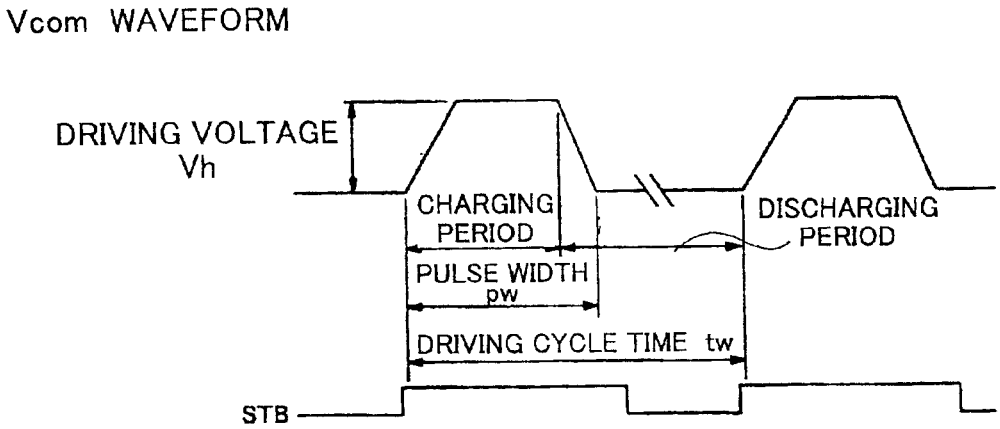
FIG. 10 is a schematic drawing explaining waveform parameters defining the common driving waveform showed in FIG. 9, FIGS. 11A and 11B are schematic drawings showing the relationship between the driving voltage of a driving pulse and a dot diameter according to an embodiment of the present invention.

As showed in FIG. 10, waveform parameters of a driving pulse of the common driving waveform Vcom includes drive voltage Vh, charging driving period (rise time), discharging driving period (fall time) and pulse width Pw.

When a driving pulse is applied to the ink jet head, drive voltage Vh of the driving waveform Vcom rises up to a high level, stays at the high level for a certain period, then falls down to a low level.

The time period in which the driving voltage Vh is rising up to and staying at the high level is a charging period required to drive the head. Ink drops are discharged during this charging period.

When the drive voltage Vh falls from the high level the energy (pressure) in the ink jet head is reduced. The head operates in this manner and repeatedly discharges ink drops to form an image.

Figure 11A:
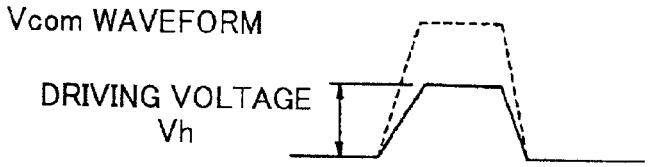
Figure 11B:
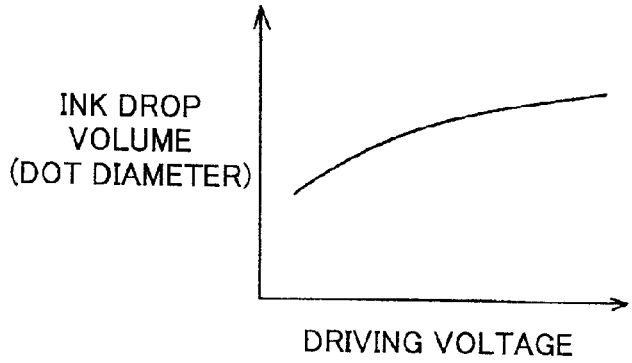

When the drive voltage Vh of the common driving waveform Vcom (driving pulse) changes as showed in FIG. 11A, the dot diameter formed by an ink drop changes. FIG. 11B illustrates the relationship between the driving voltage Vh and the volume of discharged ink drop (dot diameter increases with voltage).

Figure 12A:
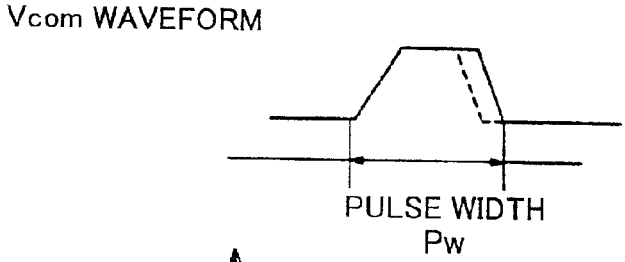
FIGS. 12A and 12B are schematic drawings showing the relationship between the pulse width of a driving pulse and a dot diameter according to an embodiment of the present invention.
Figure 12B:
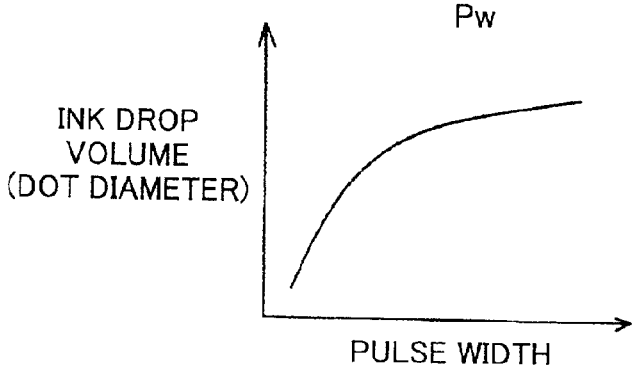

When the pulse width Pw of the common driving waveform Vcom (driving pulse) changes as showed in FIG. 12A, the dot diameter formed by an ink drop changes. FIG. 12B illustrates the relationship between the pulse width Pw and the volume of discharged ink drop (dot diameter). As pulse width Pw of the common driving waveform Vcom (driving pulse) increases, the quantity of ink in the ink drop ejected also increases (the dot diameter increases).

The first embodiment of the head drive control will be described by reference to FIGS. 13–15. As to this ink jet recording apparatus, the common driving waveform Vcom consists of three driving pulses P1–P3 in a driving cycle time tw as showed in FIG. 13.

Three driving pulses P1–P3 makes one dot of a designated recording density. Three driving pulses P1–P3 of the common driving waveform Vcom are selected by selection signals M1, M2, and M3.

Figure 13:
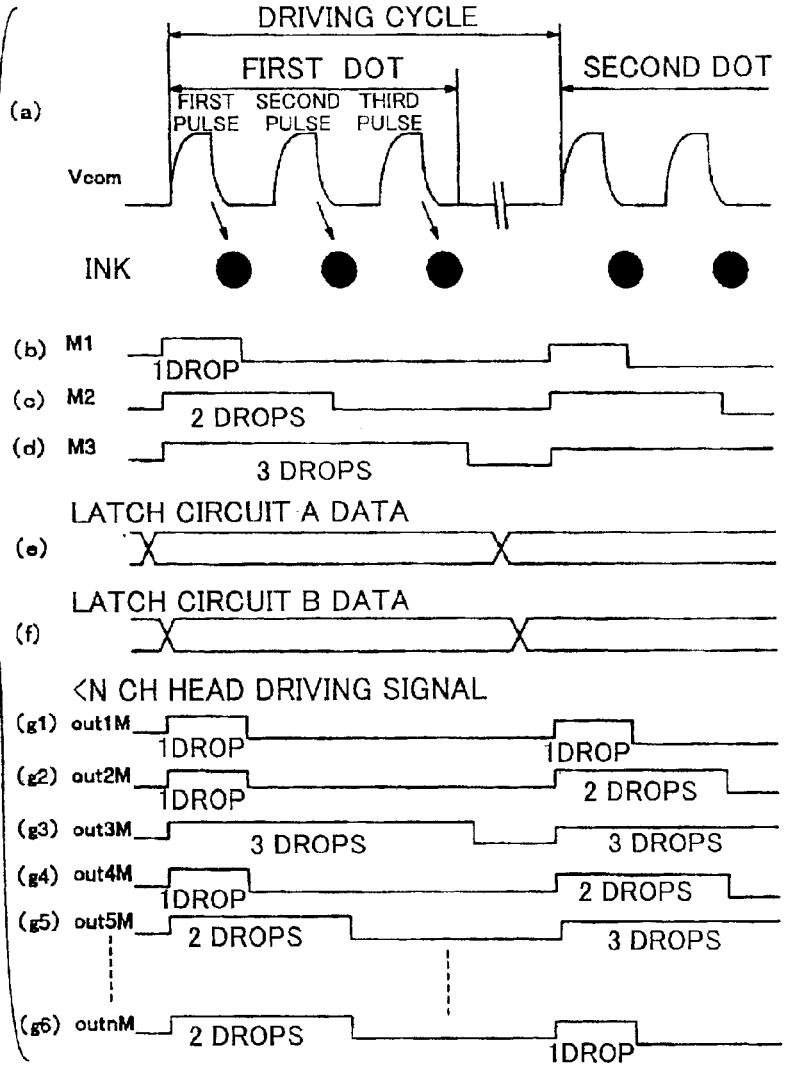
FIG. 13 shows waveforms and a timing diagram of the head driving unit according to the first embodiment of the present invention.

As showed in FIG. 13, selection signal M1 is the signal to select only the first driving pulse P1. Selection signal M2 is the signal to select both of the first and second driving pulses P1 and P2. Selection signal M3 is the signal to select all of three driving pulses P1, P2, and P3.

That is, when this selection signal M1 is selected, only one ink drop is discharged. When selection signal M2 is selected, two ink drops are discharged. When selection signal M3 is selected, three ink drops are discharged. Selection signals M1–M3 are selected based on the combination of the data of the latch circuit 83*a* (a data) and the data of the latch circuit 83*b* (b data).

In this embodiment as showed in FIG. 14, when the combination of "a data" and "b data" is "0, 0", no selection signal M (M1–M3) is selected (that is, no printing). When "1, 0", selection signal M1 is selected so that one ink drop is discharged. When "0, 1", selection signal M2 is selected so that two ink drops are discharged. When "1, 1", selection signal M3 is selected so that three ink drops are discharged.

For example, as shown in FIG. 13, "a data" of the latch circuit 83*a* (shown in (e)) and "b data" of the latch circuit 83*b* (shown in (f)) are provided to the select circuit 84. As shown in FIG. 13 (shown as (g1)–(gn)), one of selection signals M1–M3 is selectively output to the analog switch AS1–ASn of each channel CH1–CHn of the head based on the combination of "a data" and "b data". Or none of the selection signals M1–M3 is selected.

The analog switches AS1–ASn are turned ON while one of selection signals M1–M3 is input. Accordingly, the common driving waveform Vcom is applied to the piezoelectric element 52 of the head 14, which causes the head 14 to discharge ink drops.

It should be understood that the dot diameter of ink drops can be changed by selecting the selection signal M1–M3 depending on the desired recording density.

For example, as showed in FIG. 14, the first pulse P1 can be optimized so that, when one ink drop is discharged, the dot diameter of the recording density 1200 DPI is obtained.

Additionally, the second pulse P2 can be optimized so that, when two ink drops are discharged (one discharged in response to the first pulse P1 that results in a dot diameter of 1200 DPI recording density, and the other discharged in response to the second pulse P2), the dot diameter of the recording density 600 DPI is obtained in total.

Similarly, the third pulse P3 can be optimized so that, when three ink drops are discharged (one discharged in response to the first pulse P1 that results in a dot diameter of 1200 DPI recording density, the second one discharged in response to the second pulse P2 that results in a dot diameter of 600 DPI, and the third one discharged in response to the third pulse P3), the dot diameter of the recording density 300 DPI is obtained in total.

That is, the common driving waveform consists of a plurality of driving pulses, and a plurality of selection signals and a plurality of data storage units to select one of the plurality of selection signals are provided.

Accordingly, the recording density can be changed for each nozzle by changing the dot diameter using the simple structure described above.

Additionally, when multiple value recording is desired, the ink drop (a change of a dot diameter) can be achieved by selecting none or one of the selection signals M1–M3.

In this case, four value recording is possible including the case where none of the selection signals M1–M3 is selected.

That is, as showed in FIG. 14, three kinds of dot diameters, small drop, medium drop, and large drop, are available in the following manner. The first pulse P1 is optimized so that one ink drop discharged in response to the first pulse P1 makes the small drop.

The second pulse P2 is optimized so that two ink drops discharged in response to the first and second pulses P1 and P2 make the medium drop. The third pulse P3 is optimized so that three ink drops discharged in response to the first, second, and third pulses P1, P2, and P3 make the large drop.

That is, a plurality of driving pulses constituting the common driving waveform, a plurality of selection signals, and a plurality of data storage units to select the selection signals realize the adjustment of dot diameter for multiple value recording for each nozzle with a simple structure.

Figure 15:
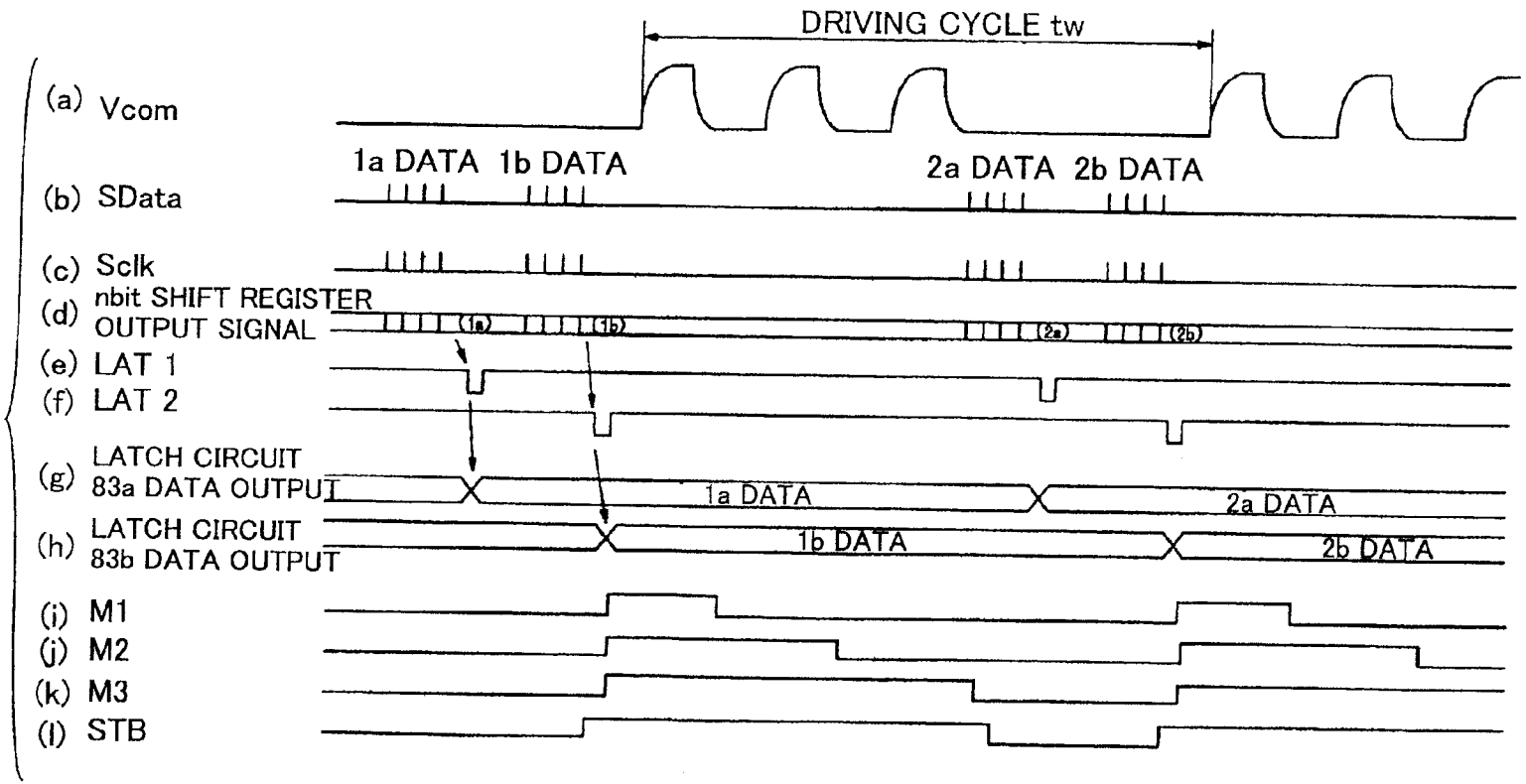
FIG. 15 shows waveforms and a timing diagram illustrating the generation of selection signals according to the first embodiment of the present invention.

By reference to FIG. 15, the generation of "a data" and "b data" is explained. The common driving waveform Vcom shown in (a) is the same as the above. SData showed in (b) is serial data. The main control unit 71 transfers n bit "a data" (nEL W) and n bit "b data" to the shift register circuit 82.

In this case, the main control unit 71 creates n bit "a data" and n bit "b data" based on the nozzle data for either case of recording density or multiple value control, and transfers the data to the head driving control circuit 81.

These "a data" and "b data" are stored in the shift register circuit 82 in response to shift clock Sclk showed in (c) and output as showed in (d). The first "a data" are stored by the latch circuit 83*a* as showed in (g) in response to the latch signal LAT1 showed in (e). The "b data" are stored by the latch circuit 83*b* as showed in (h) in response to the latch signal LAT2 showed in (f).

The "a data" and "b data" stored in the latch circuits 83*a* and 83*b* are input to the selector circuit 84. The selector circuit 84 selects, depending on the combination of "a data" and "b data", one of selection signals M1–M3 showed in (i)–(k), or selects that the selector circuit 84 outputs none of selection signals M1–M3.

The selector circuit 84 outputs the result of its selection as Out1M–OutnM to the analog switches AS1–ASn, respectively, through the group of gate circuits 85. The gate circuits 85 input storobe signal STB as input other than the selection signals M from the selector circuit 84.

The second embodiment of head drive control will be described next by reference to FIGS. 16 and 17. When a nozzle has not been driven for a long time, the viscosity of ink near the nozzle surface usually becomes high. When the nozzle is driven in a image forming operation, the high viscosity of ink increases the risk of a discharging problem.

In order to eliminate this risk before a regular image forming operation, it is effective to drive the nozzle to the extent where ink is not discharged yet so that the ink near the nozzle surface is stirred and its viscosity is reduced.

Figure 16:
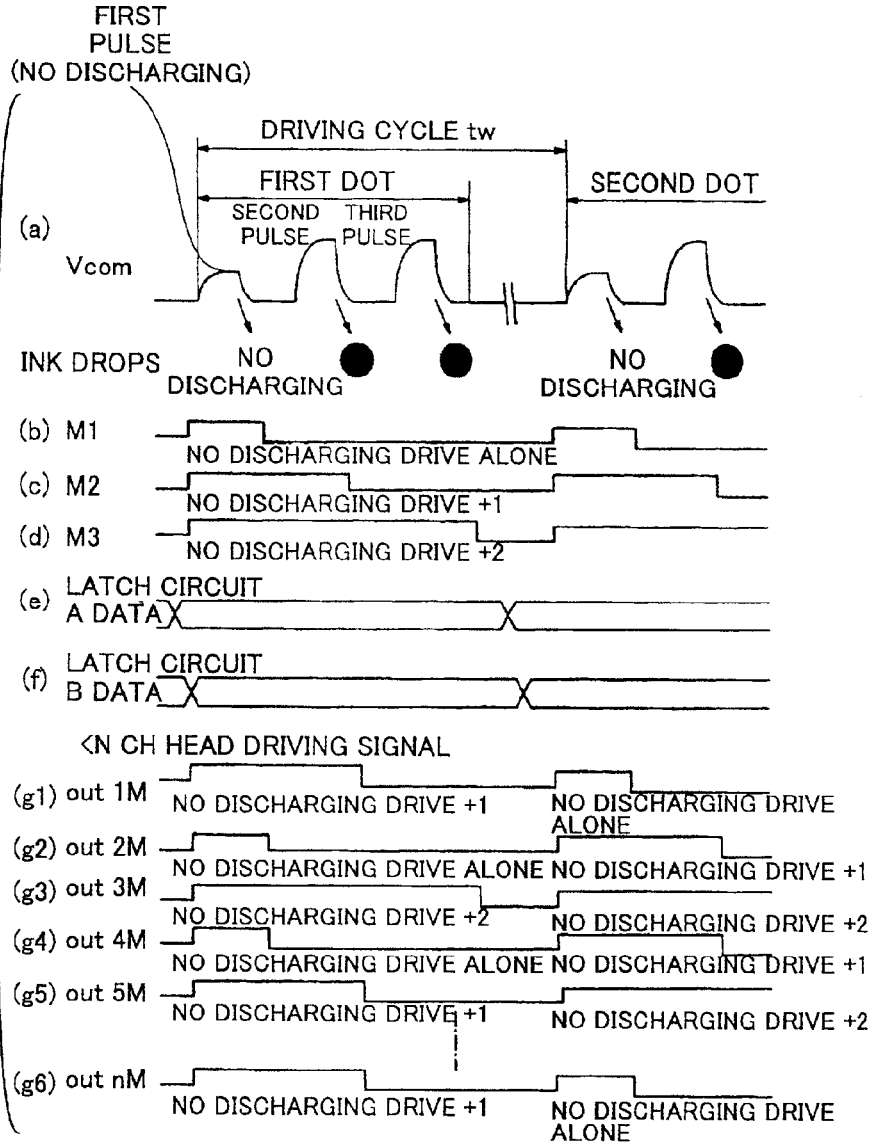
FIG. 16 shows waveforms and a timing diagram of the head driving unit according to the second embodiment of the present invention.

Therefore, in this second embodiment, as shown in FIG. 16, the driving voltage Vp of the first pulse P1 (drive voltage Vh) of the common driving waveform Vcom having a plurality of pulses is set at a voltage so that no ink drop is discharged. The driving of a nozzle by this driving pulse so that no ink drop is discharged is called "no discharging drive".

In this case, as showed in (b)–(d), the selection signals M1, M2 and M3 become signals for "no discharging drive alone", "no discharging drive +1 drop ", and "no discharging drive +2 drops", respectively.

As showed in FIG. 17, the selection signals M1–M3 correspond to the combination of "a data" stored in the latch circuit 83*a* and "b data" stored in the latch circuit 83*b* as follows: when "a data" and "b data" are (0, 0), then no selection signal M is output (that is, no recording); when (1, 0), then the selection signal M1 is selected and no ink drop is discharged; when (0, 1), then the selection signal M2 is selected and one drop is discharged; and when (1, 1), then the selection signal M3 is selected and two drops are discharged.

In this embodiment, since only three pulses including the "no discharging drive" pulse M1 are contained in the common drive waveform Vcom, the maximum number of ink drops discharged is two. If more drops are required, one can increase the number of driving pulses in the common drive waveform and the number of selection signal lines In FIG. 16, waveforms (g1)–(gn) indicate examples of selection signals of head channels CH1–CHn. These selection signals M, when input to the analog switch AS1–ASn, turn on and off the analog switches AS1–ASn. While analog switches AS1–ASn are turned on, the common drive waveform Vcom is input to the piezoelectric elements 52 of channels CH1–CHn.

As described above, the head driving unit applies a driving pulse to a head in a manner such that the head does not discharge an ink drop. This "no discharging pulse" solves the problem of increased viscosity of ink and makes the discharging of ink drops stable and smooth.

In response to the case of recording density or multiple value control showed in FIG. 17, the head driving unit may have a mode in which "no discharging pulse" is applied to the head or a mode in which driving pulse is applied.

In the above embodiments, the plurality of driving pulses contained in a driving cycle that causes the head to discharge ink drops have the same waveform, and a certain number of the driving pulses are selected by the control signal.

The head driving unit may generate driving pulses having a different waveform by altering waveform parameters such as driving voltage Vh and/or pulse width Pw of each driving pulse in a driving cycle. Since the change in waveform parameters varies the dot diameter, one can change the dot diameter by selecting a driving pulse by a selection signal.

In the above embodiments, the head driving unit for driving a liquid drop discharging head according to the present invention is applied to an ink jet head. Besides ink, this head driving unit is applicable to liquid resist for patterning and gene analysis sampling, for example.

In summary, as described above, the head driving unit according to the present invention includes a waveform generation unit that generates a driving waveform, each driving waveform including a plurality of driving pulses, a data latch unit that latches data corresponding to an image, and a signal selection unit that selects one or more driving pulses to be applied to a pressurizing unit of the liquid drop discharging head in response to said data latched by said data latch unit, the driving pulses being included in said driving waveform. The signal selection unit selects a plurality of selection signals that defines the driving pulses to be applied to said pressurizing unit. Accordingly, the head driving unit, even having a simple structure, can comply with a recording density change and multiple value recording.

If the plurality of selection signals determines the number of driving pulses in said driving waveform, the structure of the head driving unit becomes simpler.

If the data latched by said data latch unit depends on a recording density, the head driving unit can change dot diameter in response to the change in recording density.

If the data latched by said data latch unit depends on a multiple valued image, the head driving unit can change dot diameter in case of multiple value recording.

If one of the plurality of driving pulses included in said driving waveform is a driving pulse that does not cause said pressurizing unit to discharge a liquid drip, the head driving unit can prevent the nozzle from clogging and ensure stable discharging of liquid drops.

Since the image forming apparatus according to the present invention includes the head driving unit according to the present invention, the image forming apparatus can change the recording density and/or record multiple valued images with a simple and low cost structure.

The image forming apparatus can change recording density by giving the head driving unit data to select a selection signal corresponding to the image density.

The image forming apparatus can record multiple valued images by giving the head driving unit data to select a selection signal corresponding to multiple-level value images.

The image forming apparatus can prevent the clogging problem of the nozzle by giving the head driving unit data to select the driving pulse in a driving waveform which is not great enough to discharge liquid drops.

The image forming apparatus can perform a stable drop discharging operation.

The preferred embodiments of the present invention are described above. The present invention is not limited to these embodiments, but various variations and modifications may be made without departing from the scope of the present invention.

This patent application is based on Japanese priority patent application No. 2001-185732 filed on Jun. 20, 2001, the entire contents of which are hereby incorporated by reference.

What is claimed is:

1. A head driving unit for driving a liquid drop discharging head having a plurality of channels, the head driving unit comprising:

a plurality of switching units corresponding to respective channels;

a waveform generation unit that generates and provides a single sequence of driving pulses common to the plurality of switching units, a plurality of the common driving pulses being included in a driving cycle;

a data holding unit that stores a data set corresponding to an image of a particular recording density; and a signal selection unit that selects one of a plurality of selection signals thereby to cause the switching unit to selectively pass a combination of the common driving pulses in the driving cycle based on the data set stored in said data holding unit, wherein each selectively passed common driving pulse causes the liquid drop discharging head to discharge a liquid drop; and the liquid drops discharged in the driving cycle form a single dot on a recording medium, the size of which is determined by the number of driving pulses in the driving cycle, the number being determined by the selected one of the plurality of selection signals.

2. The head driving unit as claimed in claim 1, wherein one of the driving pulses in the driving cycle does not cause the liquid drop discharging head to discharge a liquid drop.

3. An image forming apparatus, comprising:

a liquid drop discharging head; and a head driving unit as claimed in claim 1.

4. The image forming apparatus as claimed in claim 3, wherein the driving cycle includes a driving pulse that does not cause the liquid drop discharging head to discharge a liquid drop.

5. A method of driving a liquid drop discharging head having a plurality of channels, the method comprising the steps of:

generating a single sequence of driving pulses common to the plurality of channel of the liquid drop discharging head, a plurality of the common driving pulses being included in a driving cycle;

selecting one of a plurality of selection signals;

selectively providing a combination of the common driving pulses in the driving cycle in response to the selected one of the plurality of selection signals;

wherein each selectively provided common driving pulse causes the liquid drop discharging head to discharge a liquid drop; and the liquid drops discharged in the driving cycle form a single dot on a recording medium, the size of which is determined by the number of driving pulses in the driving cycle, the number being determined by the selected one of the plurality of selection signals.

* * * * *